US006551223B2

(12) United States Patent
Cheng

(10) Patent No.: US 6,551,223 B2
(45) Date of Patent: Apr. 22, 2003

(54) WEIGHT STACKING PLATE STRUCTURE FOR A WEIGHT TRAINING DEVICE

(76) Inventor: Tian-Jyue Cheng, P.O. Box No. 6-57, Chung-Ho City, Taipei Hsien 235 (TW)

( * ) Notice: Subject to any disclaimer, the term of this patent is extended or adjusted under 35 U.S.C. 154(b) by 121 days.

(21) Appl. No.: 09/881,708

(22) Filed: Jun. 18, 2001

(65) Prior Publication Data

US 2002/0193215 A1 Dec. 19, 2002

(51) Int. Cl.[7] ..... A63B 21/062
(52) U.S. Cl. ..... 482/99
(58) Field of Search ..... 482/93, 94, 98–103

(56) References Cited

U.S. PATENT DOCUMENTS 4,470,596 A * 9/1984 Desiderio ..... 482/98
4,691,916 A * 9/1987 Voris ..... 482/98
4,878,662 A * 11/1989 Chern ..... 482/98
5,100,128 A * 3/1992 Mabry et al. ..... 482/134
5,199,935 A * 4/1993 Gibson et al. ..... 482/98
5,342,271 A * 8/1994 Long ..... 482/98

* cited by examiner

*Primary Examiner*—Jerome W. Donnelly
*Assistant Examiner*—Victor K. Hwang

(57) ABSTRACT

The present invention is a weight stacking plate structure for a weight training device comprises of a hoisting plate disposed at the direct upper aspect of an top plate of the device, a fixing section is perpendicularly mounted at the central area of the hoisting plate for suspending a steel rope, thread teeth with a fitting nut are disposed at the proper area at the upper end of a selector rod; the first position aligning hole of the said selector rod is an oval design provided for an alloy steel screw to penetrate through the frontage of the top plate for locking in thereby to fasten the selector rod not to rotate transversely so as to avoid the transverse deviation of the position aligning hole on the rod and to avoid the occurrence of causing the selector rod to fall due to the neglected and loosened nut during operation.

3 Claims, 7 Drawing Sheets

WEIGHT STACKING PLATE STRUCTURE FOR A WEIGHT TRAINING DEVICE

BACKGROUND OF THE INVENTION

1) Field of the Invention

The present invention relates to a weight stacking plate structure of a weight training device, more specifically a structure for improving the problem of difficult or incapable alignment between a pin hole disposed on the weight stacking plates and a position aligning hole of a selector rod, for lowering the noise generated by the machine in operation and for reducing the harmful chance caused by the broken weight stacking plate thereby to increase the safe practicability of economic efficiency.

2) Description of the Prior Art

Accordingly, a weight stacking plate structure of a general weight training device, as shown in FIG. 1, mainly comprises two guide rods (11) on the two sides of the body (1) inserted into two guide holes (121) disposed on two sides of an top plate (12), a steel rope (13) mounted on a pulley set (not shown in the Figure) of the body (1) suspending on top of a screw (14) disposed with holes, the said screw (14) is threaded inside a guide tube (122) at the central area of the top plate to make a selector rod (15) disposed with several position aligning holes (151) penetrate through the guide tube (122) of the top plates (12) and several weight stacking plates (16) to enable several position aligning holes (151) to align with the holes (161) disposed on the several weight stacking plate (16) for providing the optional insertion of an insert pin (18) for fastening the selector rod (15); when the body (1) is used for conducting weight training, the user selects a number of weight stacking plates (16) according to the personal need, then uses the insert pin (17) for setting; if the holes (161) of the weight stacking plates (16) fail to align with the position aligning holes (151) of the selector rod (15) for the insertion of the insert pin (17), the user can adjust the screw (14) for correcting.

Based on the mentioned, the weight stacking structure of the general weight training device can achieve the objective of weight training, however, it has the following shortcomings during the actual operation:

1. The general weight stacking plate only allows limited unilateral tolerance of thickness, therefore, in order to align the holes of the needed weight stacking plates with the position aligning holes of the selector rod, the screw can be adjusted upward only but not downward, the said adjusting manner will make the steel rope into a pressured state while not in operation, a blocking point (such as a rubber ball or others) is also needed to be mounted at the tail end of the steel rope and that causes the inconvenience for application.
2. To use the screw for adjusting the alignment between the holes of the weight stacking plates and the position aligning holes of the selector rod will definitely influence the elasticity of the steel rope; repeating adjustment or being used for too long, the steel rope tends to break and hurt the user.
3. After selecting the number of the weight stacking plates and inserting the insert pin, since the several weight stacking plates can not be bundled into one unit, a lot of noise will be generated quite often due to the impact among the weight stacking plates, or even the weight stacking plates will break and hurt the user.
4. Usually, there is not any protector mounted inside the guide holes disposed on the two sides of the top plate, therefore, when the machine is in operation, the guide rods on the two sides tend to deviate, the guide rods and the guide holes tend to produce serious friction thereby damaging the guide rods or the guide holes.

Therefore, in view of the mentioned shortcomings and the inconvenience of the weight stacking plate of the conventional weight training device, the inventor of the present invention, based on the spirit of searching for innovation and the best, utilized the professional perspective and knowledge, researched a more practical weight stacking plate structure of a weight training device with wider application range and complying with the industrially utilizable value.

SUMMARY OF THE INVENTION

The present invention mainly comprises a hoisting plate disposed at the direct upper aspect of the top plate, a fixing section is protrusively mounted at the central area of the hoisting plate for suspending a steel rope, thread teeth with a fitting nut are disposed at the proper area at the upper end of a selector rod for adjusting the selector rod to ascend or descend; the first position aligning hole disposed on the said selector rod of the present invention is an oval design provided for an alloy steel screw to penetrate through the frontage of the top plate for locking in and for fastening the selector rod not to rotate transversely; two movable nylon tubes are mounted inside two guide tubes on two sides of the top plate and positioned by means of a C-shaped retainer for correcting the deviation of a guide rod.

The primary objective of the present invention is to utilize the design of the thread teeth at the upper end of the selector rod and the nut during penetrating the selector rod through the top plate and several weight stacking plates, the thread teeth at the upper end with the fitting nut can be used for adjusting the selector rod to ascend or descend to allow the weight stacking plate to possess limited bilateral tolerance of thickness and to correct the problem of incapable insertion of the insert pin caused by the misalignment between the holes disposed thereon and the position aligning holes of the selector rod due to the thickness difference of the weight stacking plate.

Another objective of the present invention is to bundle up the selected several weight stacking plates into one unit when the selector rod is adjusted, thereby to lower the noise and to reduce the breaking situation generated by the impact among the weight stacking plates and to increase the convenience of applying the adjustment during the operating of the machine.

Yet another objective of the present invention is to utilize the design of the hoisting plate to free the elasticity of the steel rope from being influenced Still another objective of the present invention is to utilize the movable nylon tube and the C-shaped retainer mounted inside the guide tube to keep the guide rod from deviating and to avoid the damage caused by serious friction generated between the guide tube and the guide rod.

To enable a further understanding of the objectives, the features and the functions of the present invention, the brief description of the drawings below is followed by the detailed description of an preferred embodiment.

DETAILED DESCRIPTION OF THE PREFERRED EMBODIMENTS

Figure 1:
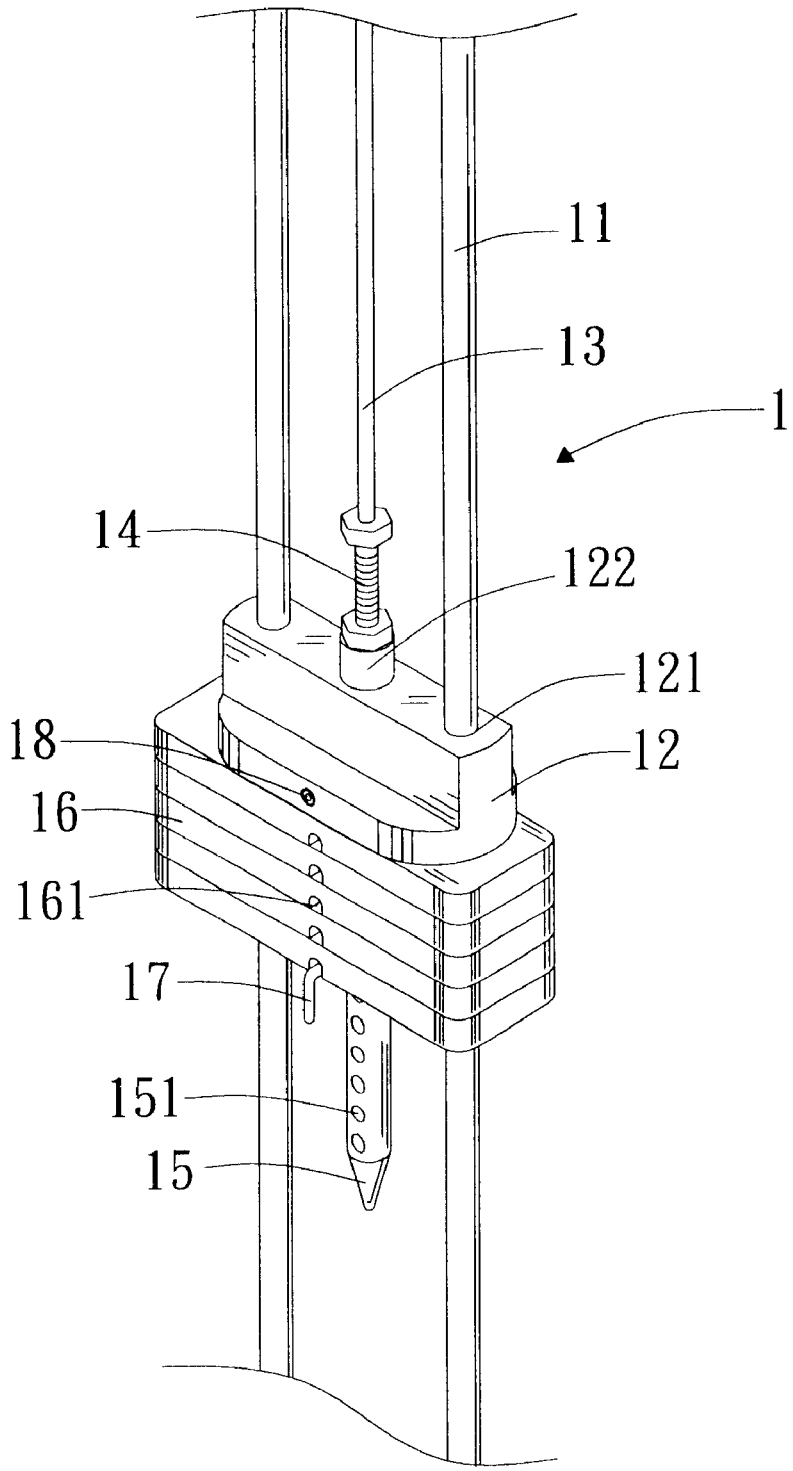
FIG.1 Prior Art
FIG. 1 is a partial pictorial drawing of the conventional structure.
Figure 2:
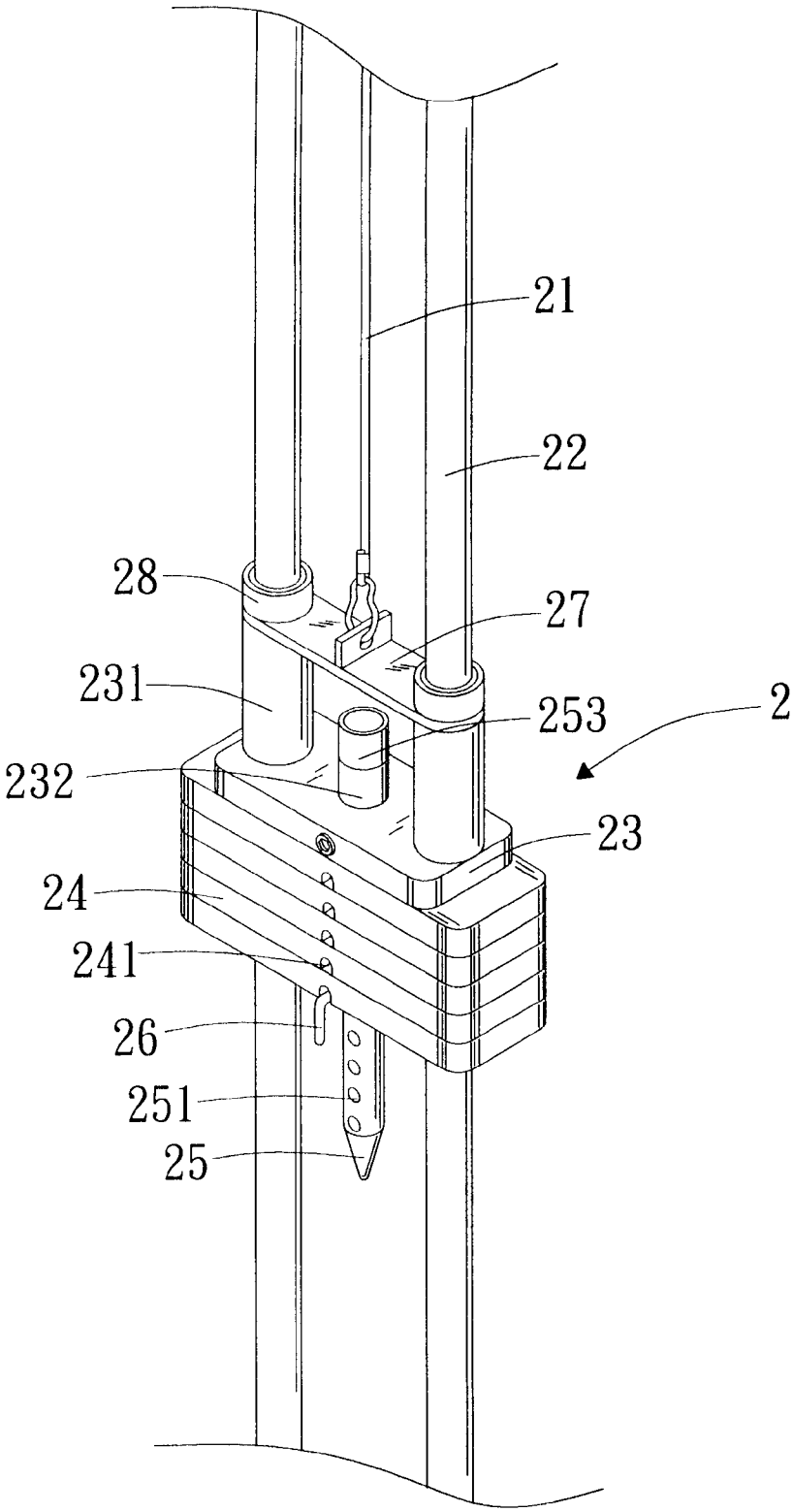
FIG. 2 is partial pictorial drawing of the present invention.
Figure 3:
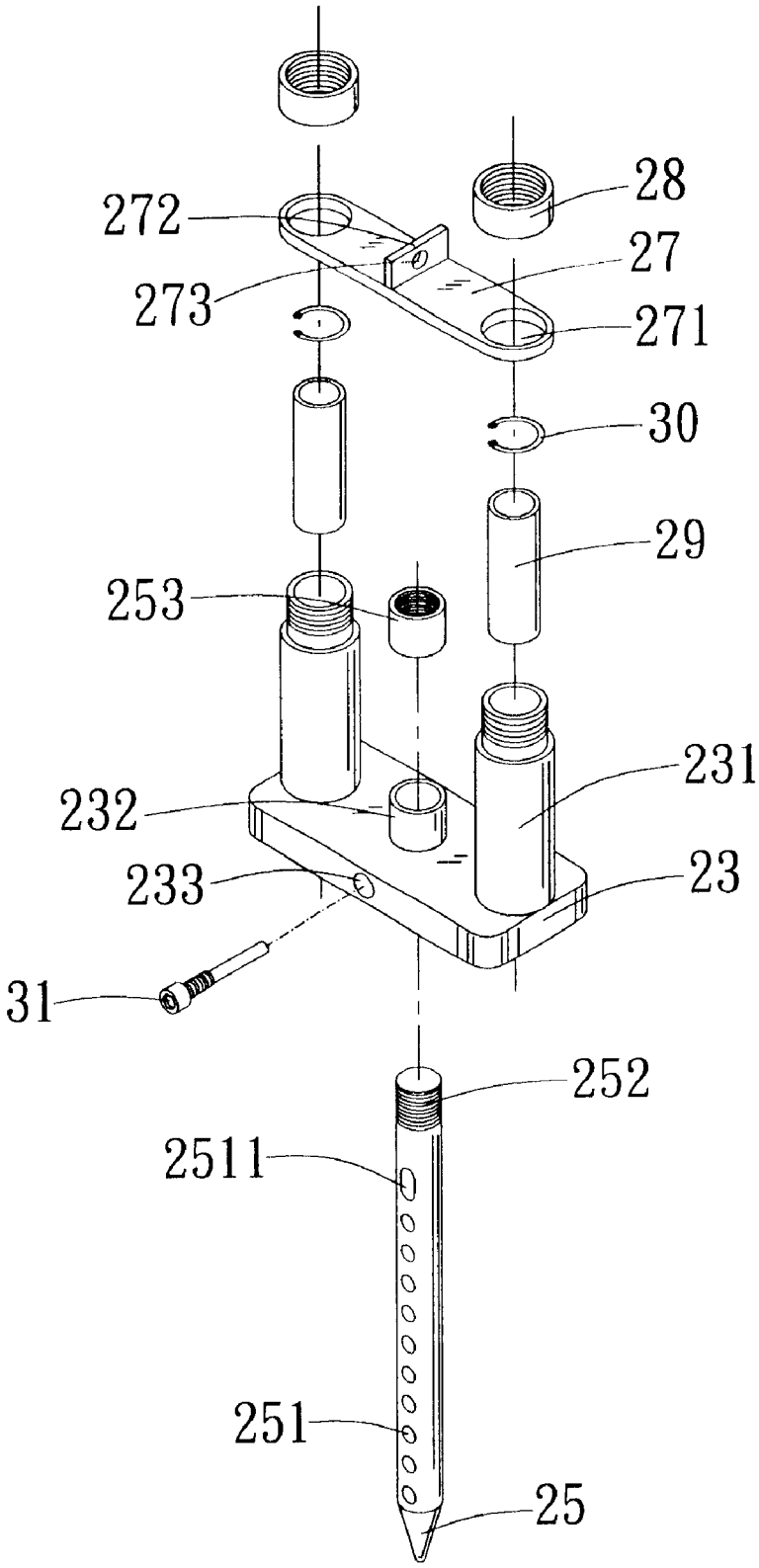
FIG. 3 is a pictorial drawing of the disassembled present invention.

Referring to FIGS. 2 and 3, the present invention utilizes a steel rope (21) mounted on a pulley set (not shown in the Figures) of a body (2) and two guide rods (22) fitted with two sides of the body (2) to conduct the up-and-down operation of several weight stacking plates (24) for people to do weight lifting training; the said guide rods (22) on two sides are inserted inside two guide tubes (231) disposed on two sides of a top plate (23), the said top plate (23) is situated at the top end of several weight stacking plates (24); a selector rod (25) disposed with several position aligning holes (251) penetrates through a guide tube (232) at the central area of the top plate (23) and several weight stacking plates (24) to enable several position aligning holes (251) on the selector rod (25) to just align with the holes (241) disposed on several weight stacking plates (24) for the optional insertion of an insert pin (26).

Based on the mentioned, the structure of the present invention is that a hoisting plate (27) is disposed at the direct upper aspect of the top plate (23), the two sides of the said hoisting plate (27) are mounted with two holes (271) provided respectively for the insertion of a cylinder sleeve (28) with wider top and narrow bottom to enable the lower end of the cylinder sleeve (28) to insert into the guide tubes (231) on the two sides of the upper plate (23) to form engagement and to fasten the hoisting plate (27); a fixing section (272) is perpendicularly mounted at the central area of the said hoisting plate (27), the said fixing section (272) is a rectangular body with a circular hole (273) disposed at the center for suspending the steel rope (21) and to facilitate the operation of the present invention by keeping the elasticity of the steel rope (21) from being influenced for normal operation; the thread teeth (252) are disposed at the proper area at the upper end of the selector rod (25) and are fitted with a nut (253) to be used for adjusting the ascending and descending of the selector rod (25) penetrating through the upper plate (23) and several weight stacking plates (24) so as to correct the problem of incapable insertion of the insert pin (26) caused by the misalignment between the holes (24) disposed on the weight stacking plates (24) and the position aligning holes (251) disposed on the selector rod (25) due to the thickness difference of the weight stacking plates (24); the first position aligning hole (2511) is designed as an oval shape, a through hole (233) is disposed on the frontage of the top plate (23); when the selector rod (25) penetrates through the top plate (23) and several weight stacking plates (24), the first position aligning hole (2511) of the selector rod (25) and the through hole (233) on the top plate (23) are formed to correspond to each other for locking in an alloy steel screw (31) instead of a common screw, thereby to fasten the selector rod (25) not to rotate transversely so as to avoid the transverse deviation of the position aligning holes (251) on the selector rod (25) and the occurrence of causing the selector rod (25) to fall due to the neglected and loosened nut (253) during operation.

To continue from the mentioned, two movable nylon tubes (29) are mounted inside the guide tubes (231) on the two sides of the said top plate (23) and fastened in position by means of two C-shaped retainers (30) for correcting the deviation of the guide rods (22) and avoiding the damage caused by the serious friction generated between the guide tubes (231) and the guide rods (22).

Figure 4:
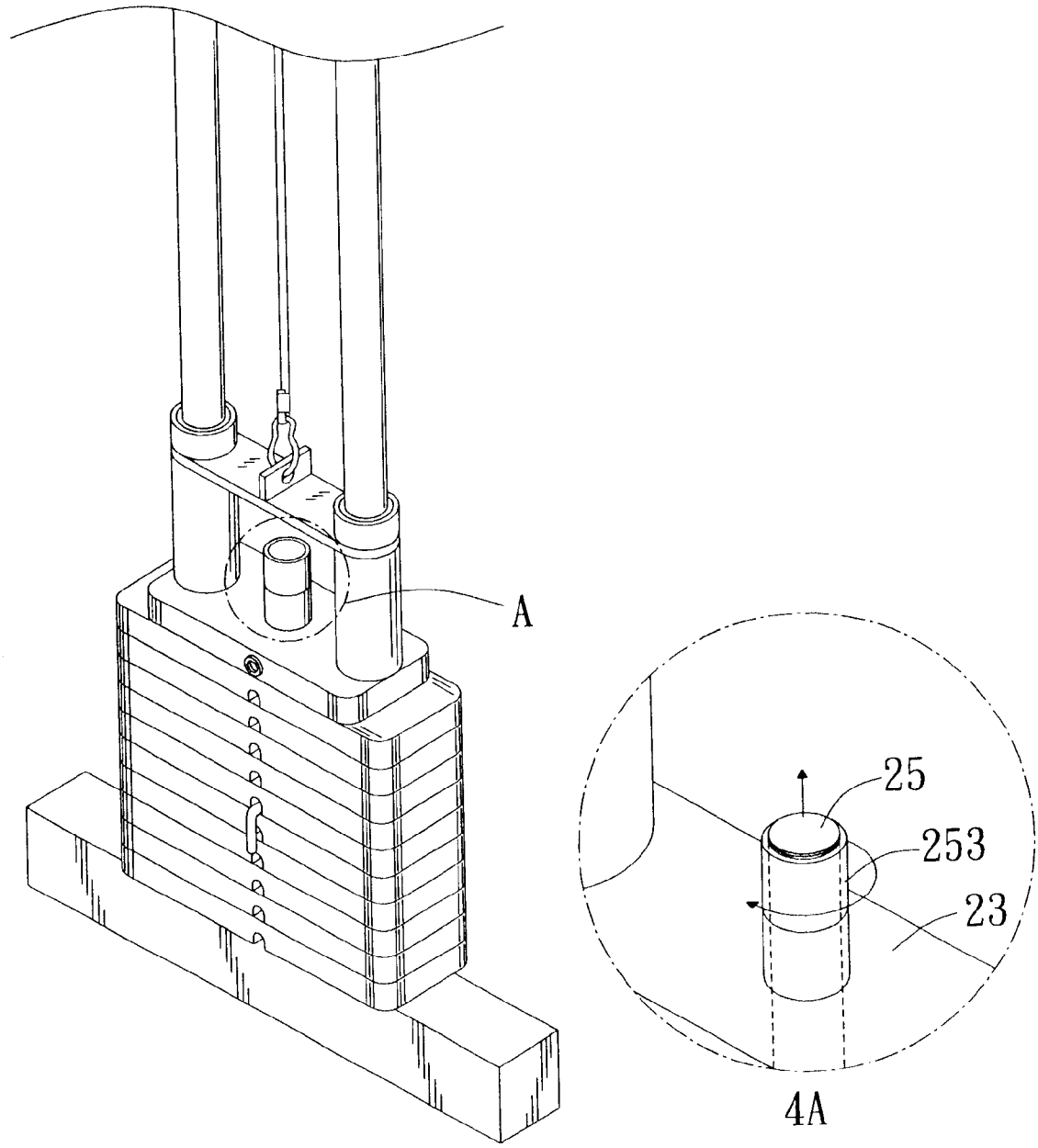
FIG. 4 is a schematic drawing of the clockwise rotating state of the present invention.
Figure 5:
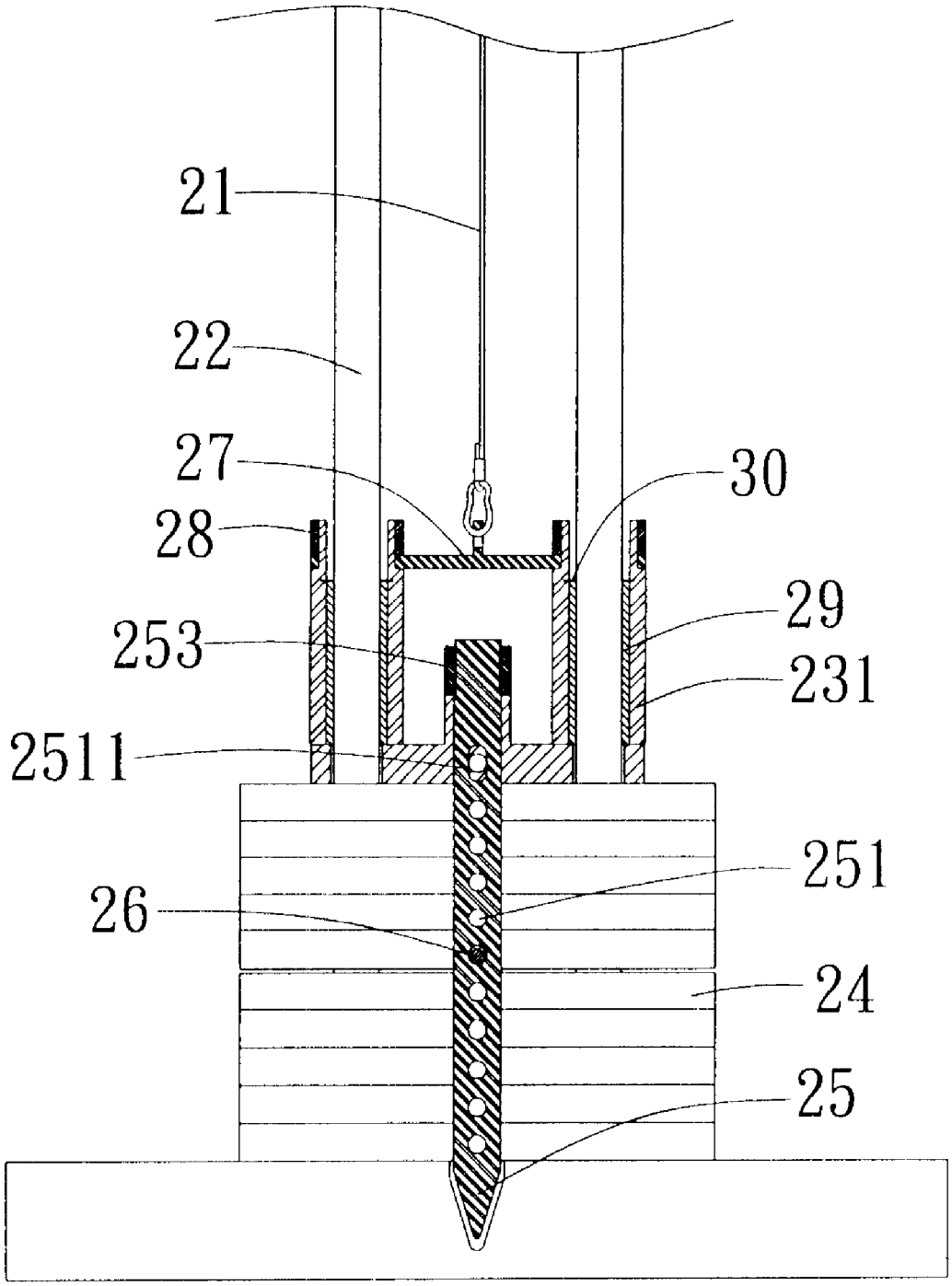
FIG. 5 is an orthographic and cross-sectional drawing of rotating state in FIG. 4.
Figure 6:
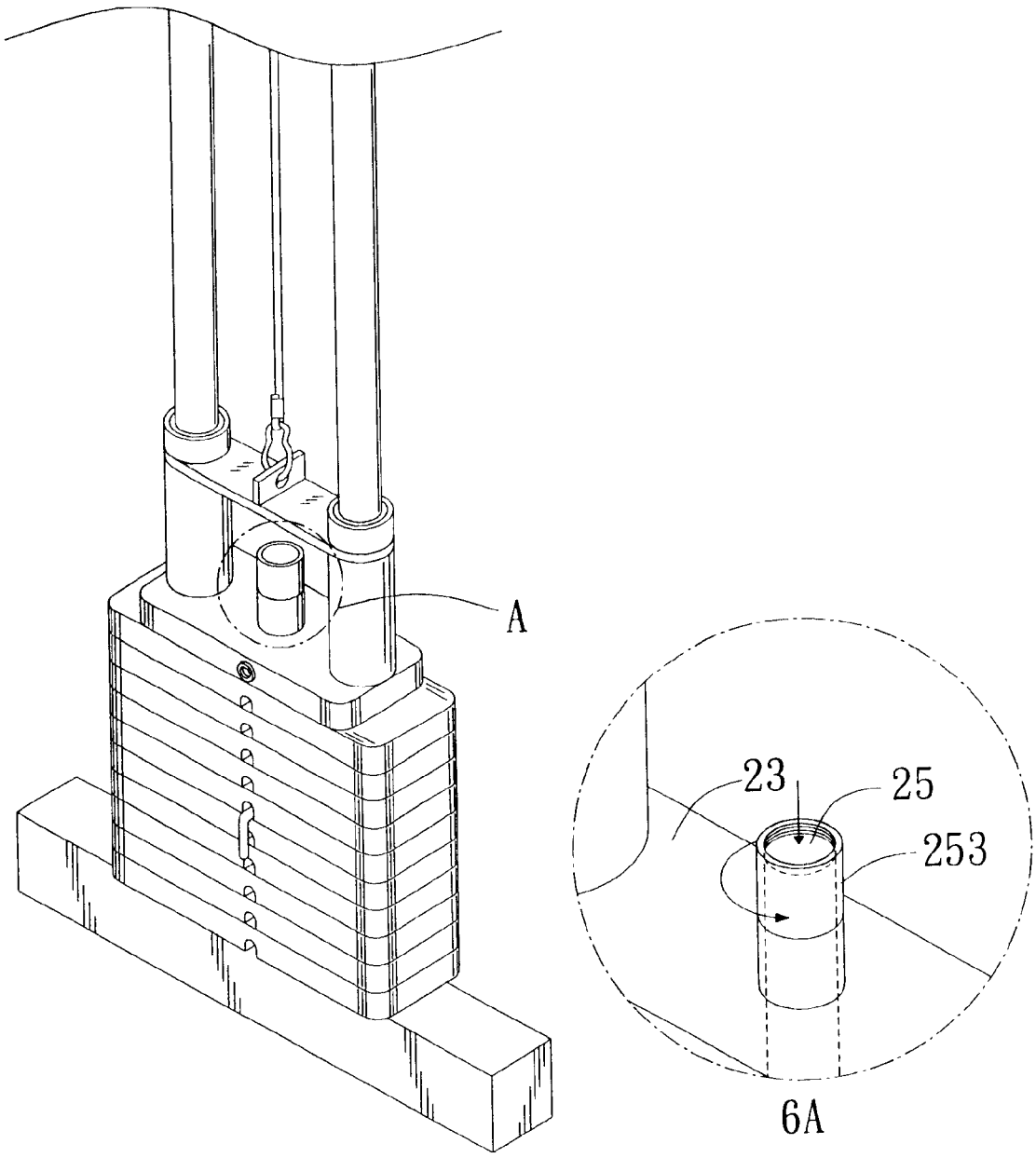
FIG. 6 is a schematic drawing of the counter clockwise rotating state of the present invention.
Figure 7:
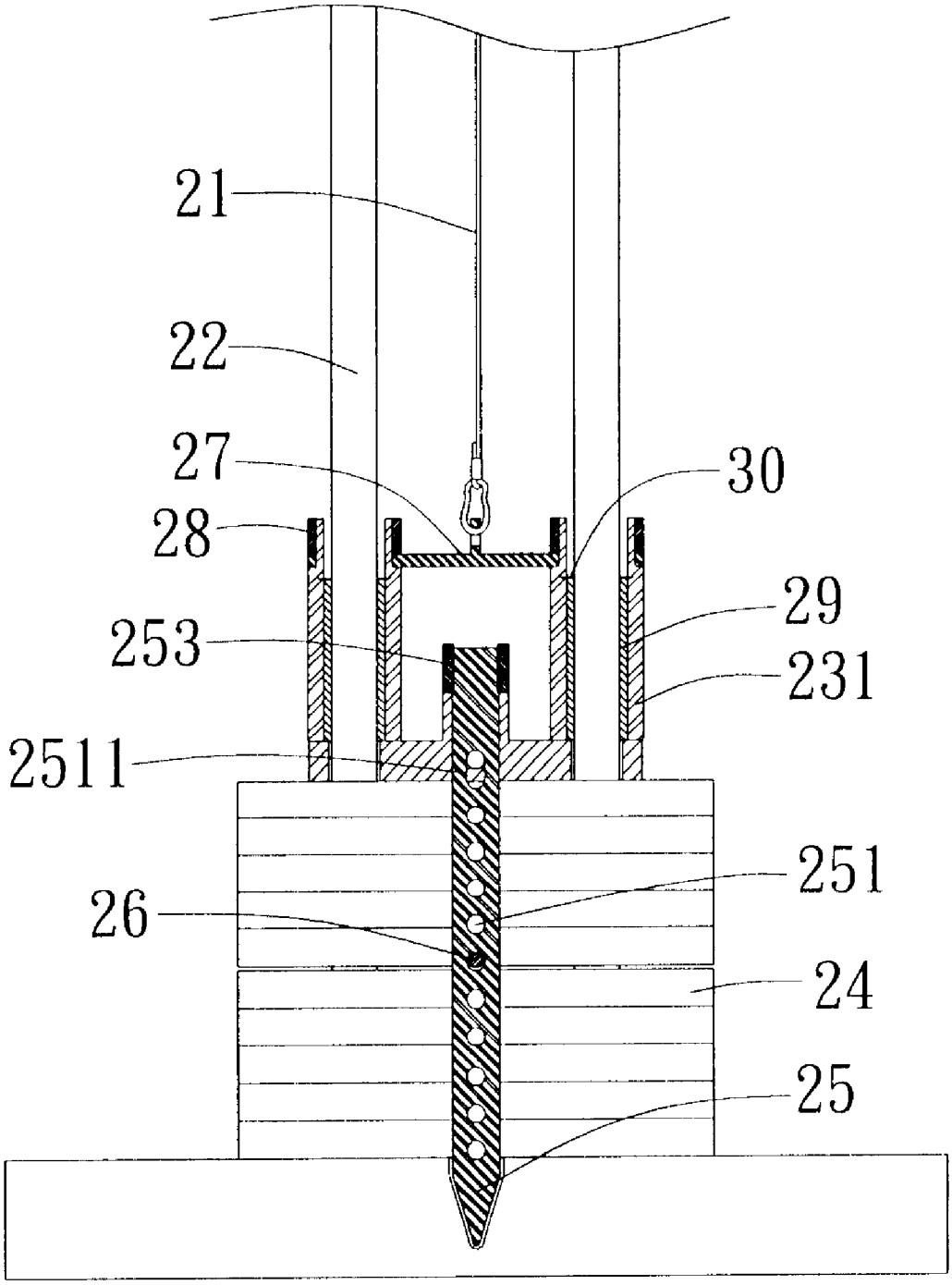
FIG. 7 is an orthographic and cross-sectional drawing of rotating state in FIG. 6.

When the present invention is used to conduct weight training, the user can select a number of the weight stacking plates (24) according to the personal need, then insert the insert pin (26) into the hole (241) on the last plate of the selected weight stacking plates (24) and the position aligning hole (251) of the selector rod (25); if the hole (241) of the weight stacking plate (24) fails to align with the position aligning hole (251) on the selector rod (25), the user can use the gap space provided by the oval-shaped first position aligning hole (2511) on the selector rod (25) to rotate the nut (253) to adjust the selector rod (25) to ascend or descend, for example, if the position aligning hole (251) on the selector rod (25) is too low, the nut (253) will be rotated clockwise, at this time, the selector rod (25) will ascend, as shown in FIGS. 4 and 5; if the position aligning hole (251) on the selector rod (25) is too high, then the nut (253) will be rotated counter clockwise to make the selector rod (25) descend, as shown in FIGS. 6 and 7.

While adjusting the selector rod (25) of the present invention, the selected weight stacking plates (24) can be bundled up into one unit to avoid generating a lot of noise and to reduce the breaking situation both caused by the impact among the weight stacking plates (24) during the operating of the machine.

In summation of the foregoing sections, the weight stacking plate structure of a weight training device possesses the advantages of convenient adjusting application, lowering the noise, reducing the damage of the device and material, etc., obviously possesses more safe practicability of economic efficiency than the weight stacking plate structure of the conventional weight training device, truly has the innovation and advancement, and truly complies with all new patent application requirements and is hereby lawfully submitted to the patent bureau for review and the granting of the commensurate patent rights.

What is claimed is:

1. A weight stacking plate structure utilizing a steel rope mounted on a pulley set of a body and two guide rods fitted with two sides of the body to conduct an up-and-down operation of several weight stacking plates for people to do weight lifting training; said guide rods on two sides are inserted inside two guide tubes disposed on two sides of a top plate, said top plate is situated at a top end of several weight stacking plates; a selector rod disposed with several position aligning holes penetrates through the top plate and several weight stacking plates to enable several position aligning holes on the selector rod to just align with holes disposed on several weight stacking plates for the optional insertion of an insert pin; the improvement comprising: a hoisting plate disposed at a direct upper aspect of the top plate, a fixing section is perpendicularly mounted at a central area of said hoisting plate for suspension of the steel rope; thread teeth are disposed at an upper end of the selector rod and are fitted with a nut for adjusting ascent and descent of the selector rod penetrating through the top plate and several weight stacking plates so as to correct difficulties in insertion of the insert pin caused by any misalignment between the holes disposed on the weight stacking plates and the position aligning holes disposed on the selector rod due to any thickness difference of the weight stacking plates; a first of the position aligning holes is designed as an oval shape for locking in an alloy steel screw penetrated through a front of the top plate thereby to fasten the selector rod not to rotate transversely to avoid transverse deviation of the position aligning holes on the selector rod and which may cause the selector rod to fall due to neglect and loosening of the nut during operation.

2. The weight stacking plate structure of a weight training device according to claim 1, wherein two movable nylon tubes are mounted inside the guide tubes on the two sides of said top plate and fastened in position by means of two C-shaped retainers to correct deviation of the guide rods and to avoid damage caused by serious friction between the guide tube and the guide rod.

3. The weight stacking plate structure of a weight training device according to claim 1, wherein when the selector rod is adjusted, several selected weight stacking plates can be bundled up into one unit to avoid generating a lot of noise and to reduce a breaking situation, both caused by impact among the weight stacking plates during operating of the device.

* * * * *